United States Patent [19]

Minner et al.

[11] 4,422,033

[45] Dec. 20, 1983

[54] TEMPERATURE-STABILIZED VOLTAGE SOURCE

[75] Inventors: Willy Minner, Schwaigern; Rolf Böhme, Bad Friedrichshall; Martin Siegle, Weinstadt; Heinz Rinderle, Heilbronn, all of Fed. Rep. of Germany

[73] Assignee: Licentia Patent-Verwaltungs-GmbH, Frankfurt, Fed. Rep. of Germany

[21] Appl. No.: 330,811

[22] Filed: Dec. 15, 1981

[30] Foreign Application Priority Data

Dec. 18, 1980 [DE] Fed. Rep. of Germany ..... 3047685

[51] Int. Cl.[3] ..... G05F 3/08; G05F 1/58

[52] U.S. Cl. ..... 323/314; 323/907

[58] Field of Search ..... 323/311-317, 323/907; 330/288, 297

[56] References Cited

U.S. PATENT DOCUMENTS

| | | | |
|---|---|---|---|
| 3,887,863 | 6/1975 | Brokan | 323/314 |
| 3,893,018 | 7/1975 | Marley . | |
| 4,074,181 | 2/1978 | Crowle . | |
| 4,085,359 | 4/1978 | Ahmed | 323/314 |
| 4,249,123 | 2/1981 | Kwan | 323/314 |
| 4,349,778 | 9/1982 | Davis | 323/314 |
| 4,362,985 | 12/1982 | Tsuchiya | 323/314 |

FOREIGN PATENT DOCUMENTS 2457753 6/1975 Fed. Rep. of Germany .

OTHER PUBLICATIONS

R. J. Widlar, New Developments in IC Voltage Regulators, *ISSCC*, Feb. 20, 1970, pp. 158-159.

Pietro Menniti, Pelligrini and Seragnoli, A New Voltage Regulator Protects the Automotive Electronics, IEEE, 1980, pp. 211 and 219.

Robert A. Blauschild et al., A New NMOS Temperature-Stable Voltage Reference, *IEEE Journal of Solid-State Circuits*, vol. SC-13, No. 6, Dec. '78, 767-773.

*Primary Examiner*—William H. Beha, Jr.

*Attorney, Agent, or Firm*—Spencer & Frank

[57] ABSTRACT

In a circuit producing an output voltage independent of temperature and comprising first and second pairs of interconnected transistors arranged in parallel circuit branches, the active transistor areas of the transistors within each pair are arranged to be different.

10 Claims, 6 Drawing Figures

$U_{REF} = 1.205\ V$ $$U_{REF} = U_{BE2} + \frac{R_1}{R_3} U_T \ln \frac{R_1}{R_2}$$

$U_{REF} \sim 2.5\ V$ $$U_{REF} = 2U_{BE1} + \frac{R_1}{R_2} U_T \ln Fa$$

$$Fa = \frac{\text{emitter area of } T_2}{\text{emitter area of } T_1} > 1$$

TEMPERATURE-STABILIZED VOLTAGE SOURCE

BACKGROUND OF THE INVENTION

In electrical circuits, more particularly in complex integrated circuits, reference voltage sources are required which deliver a constant output voltage which is independent of the temperature, loading and amplitude of the feed voltage. A known circuit suitable for this purpose is the so-called "Widlar circuit" or band gap reference circuit which is disclosed in the journal of the IEEE, 1970, "International Solid-State Circuits Conference," pp. 158 to 159. Such a circuit has three resistors.

There is also known a modification of the above circuit which comprises only two resistors.

There is also known a further modification of the above circuits from the journal of the IEEE 1980, page 219.

The above-mentioned circuits are described in detail below with reference to FIGS. 1, 2 and 3 respectively of the drawings.

SUMMARY OF THE INVENTION

It is an object of the invention to provide an improved temperature stable voltage source.

According to the invention there is provided a temperature-stabilized voltage supply circuit comprising first and second parallel-connected circuit branches, first and second pairs of interconnected transistors, one transistor from each pair lying in each circuit branch, electrical supply means connected to said current branches, a third circuit branch connected in parallel to said first and second circuit branches, and circuit output means for the temperature-stabilized voltage wherein the active transistor areas of the transistors within each of said pairs are different.

Further according to the invention there is provided a temperature-stabilized voltage source comprising first and second parallel-connected current branches, a first pair of transistors with their base electrodes interconnected, a current image amplifier comprising a second pair of transistors with their base electrodes interconnected, said second pair of transistors being complementary to said first pair, one transistor each of said pairs lying in each said current branch, a first resistor connected to the emitter of the transistor of said first pair which lies in said second current branch, a second resistor connected in series with said parallel-connected current branches, a third current branch comprising a fifth transistor, the base electrode of said fifth transistor being connected to said first current branch, an activating current branch, said base electrode of said fifth transistor being further connected to said activating current branch, said activating current branch comprising a current source and a sixth transistor, the emitter of said sixth transistor being connected to said base electrodes of said first pair of transistors, and a circuit output for the temperature-stabilized voltage, said emitter of said sixth transistor being further connected to said circuit output, wherein said transistor of said first pair which lies in said second current branch has an active transistor area greater than the active transistor area of the other transistor of said first pair, and the transistor of said second pair which lies in said first current branch has an active transducer area greater than the active transistor area of the other transistor of said second pair.

BRIEF DESCRIPTION OF THE DRAWINGS

The invention will now be described in greater detail, by way of example, with reference to the drawings, in which.

DESCRIPTION OF THE PREFERRED EMBODIMENTS

Basically the invention is based on a temperature stable voltage source with a first base-coupled transistor pair in two parallel connected current branches in which one transistor has an emitter resistor in the second current branch with a second transistor pair coupled to the base, forming a current image amplifier and comprising transistors complementary to the first pair in which in each case one transistor of each pair lies in one of the two current branches with a second resistor ($R_1$) in series with the pair of current branches, and a third current path which contains a fifth transistor in which the base electrode of the fifth transistor is connected to the first current branch which does not contain any additional resistor, and with an activating current branch which comprises a current source and a sixth transistor in which the emitter of the sixth transistor, which is connected to the base electrodes of the transistors of the first transistor pair, forms the circuit output for the stabilized voltage.

Before describing the invention in detail, it is helpful to consider circuits which are already known.

Figure 1:
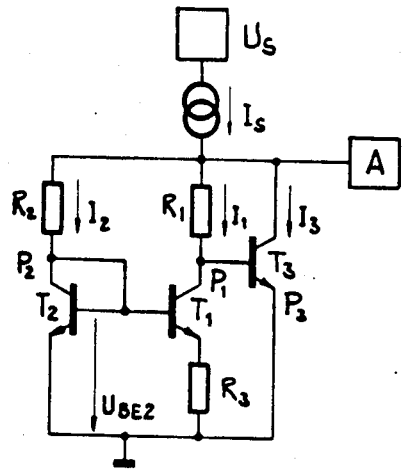
PRIOR ART Fig.1
FIG. 1 shows a known circuit of the Widlar or band gap reference type.

The Widlar or band gap reference circuit in accordance with FIG. 1 comprises three parallel connected current branches $P_1$, $P_2$ and $P_3$, each having an npn transistor $T_1$, $T_2$ and $T_3$. A constant current source is connected between the voltage source $U_S$ and the circuit comprising the three parallel connected current branches $P_1$ to $P_3$ and delivers the current $I_S$. The transistor $T_2$ is operated as a diode with a short-circuited base collector path. The transistor $T_3$ is provided with a negative feedback voltage via the resistor $R_1$. At the collector of $T_1$ the transistor $T_3$ sets its base emitter voltage. On the condition that $I_2$ in the current branch $P_2$ is equal to $I_3$ in the current branch $P_3$ the circuit delivers at the output terminal A the temperature independent reference voltage:

$$U_{REF} = U_{BE2} + \frac{R_1}{R_3} \cdot U_T \ln \frac{R_1}{R_2} .$$

when the following is true:

$$\upsilon U + \frac{R_1}{R_3} \cdot \frac{K}{e_0} \cdot \ln \frac{R_1}{R_2} = 0$$

$\upsilon$ U is the temperature effect of the base emitter voltage of transistor $T_2$ with a value of approx. $-2$ mV/°C. K is the Boltzmann constant and $e_0$ is the elementary charge. According to the above equation the independence of temperature of the circuit shown in FIG. 1 relies on the ratio of the three resistors $R_1$, $R_2$ and $R_3$ which are contained in the circuit. The temperature independence is achieved for example when the resistors $R_2$ and $R_3$ are ten times smaller than the resistor $R_1$. In these conditions and when using silicon transistors at the output A the voltage $U_{REF}=1.205$ V. This voltage is designated by the band gap of the semiconductor material and therefore is termed a bandgap reference voltage.

In the circuit shown in FIG. 1, the fact that three resistors have to be exactly tuned with respect to each other inside the circuit is particularly inconvenient. Moreover, the feed current $I_s$ is subject to strict requirements with respect to its absolute value and its independence of temperature.

Figure 2:
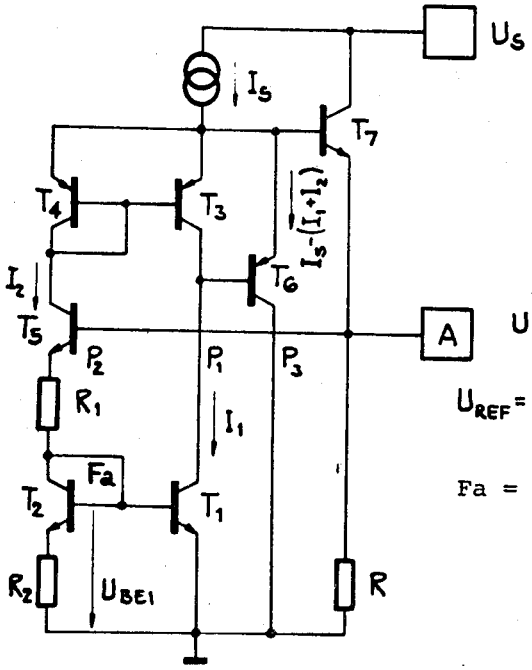
PRIOR ART Fig.2
FIG. 2 shows a known circuit which is a modification of the circuit shown in FIG. 1.

The circuit shown in FIG. 2, which is also known, forms an improvement in the circuit shown in FIG. 1, since the circuit shown in FIG. 2 only contains two resistors $R_1$ and $R_2$. The circuit shown in FIG. 2 contains a current image amplifier comprising the transistors $T_4$ and $T_3$, so that the currents $I_1$ and $I_2$ are of equal size. In series with the transistor $T_4$ of the current image amplifier, which is connected as a diode, is connected a transistor $T_5$ the base of which is connected to the emitter connection of the transistor $T_7$, this emitter of the transistor $T_7$ at the same time forming the output connection A for the temperature stabilized voltage $U_{REF}$. The transistor pair comprising the transistors $T_1$ and $T_2$ is connected as a current image amplifier and the transistor $T_2$ which is operated as a diode contains the emitter resistor $R_2$. The current through the third current path $P_3$ arises from the difference between the feed current $I_S$ and the sum of the currents flowing through the current paths $P_1$ and $P_2$. In this circuit the reference voltage $U_{REF}$ is approximately 2.5 V at the output A. This arises from the relationship:

$$U_{REF} = 2\,U_{BE1} + \frac{R_1}{R_2}\,U_T \cdot \ln Fa.$$

The term $2\,U_{BE1}$ represents the sum of the base emitter voltage drops across the transistor $T_1$ and transistor $T_5$, while the remaining voltage component is determined by the resistor ratio $R_1/R_2$ and the ratio of the areas of the active transistor areas within the transistors $T_1$ and $T_2$. The voltage $U_{REF}$ is then dependent on temperature if the following is true:

$$2v\,U + \frac{R_1}{R_2} \cdot \frac{K}{e_0}\,\ln Fa = 0.$$

Fa is the ratio between the emitter area of the transistor $T_2$ and the emitter area of the transistor $T_1$. The condition according to the last formula is given at a surface ratio of Fa=5 for example if the ratio between the resistance is:

$$R_1/R_2=28.8$$

In the circuit shown in FIG. 2, the fact that the current $I_1$ and $I_2$ are derived from the stabilized voltage $U_{REF}$, is considered to be advantageous whereas the transistor $T_6$ discharges the excess feed current $I_S-(I_1+I_2)$ in the third current branch $P_3$. Furthermore only the two resistors $R_1$ and $R_2$ are still required. The fact that the resistor ratio of resistors $R_1$ and $R_2$ is relatively large is considered disadvantageous and cannot be reduced without limitations even when the ratio Fa of the areas is increased considerably. In this connection, attention is drawn to curve a in FIG. 5. Curve a shows the ratio $R_1/R_2$ as a function of the area ratio Fa when there is full temperature compensation. As can be seen from the curve the ratio $R_1/R_2=28.8$ with an area ratio of Fa=5. This large resistor ratio can only be controlled with great difficulty in integrated circuits with the required accuracy.

Figure 3:
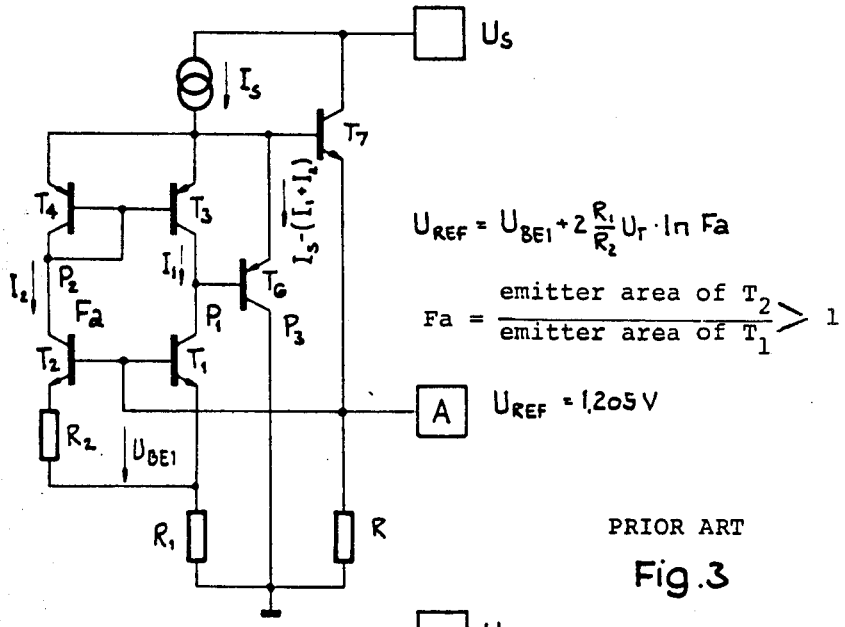
PRIOR ART Fig.3
FIG. 3 shows a further known circuit.

It was possible to reduce the resistor ratio with the aid of the circuit shown in FIG. 3. This circuit is known from the journal of the IEEE 1980, page 219. It differs essentially from the circuit shown in FIG. 2 in the fact that the currents $I_1$ and $I_2$ are discharged through the current branches $P_1$ and $P_2$ jointly via the resistor $R_1$. The two current branches $P_1$ and $P_2$ have only two transistors each, the transistor pair $T_3$ and $T_4$ forming a current image amplifier. The transistors of the transistor pair $T_1$ and $T_2$ are complementary to the transistors $T_3$ and $T_4$ of the current image amplifier. The output voltage $U_{REF}$ at the output A is derived at the emitter electrode of the transistor $T_7$ which is connected to the base electrodes of the transistors $T_1$ and $T_2$. The third current branch $P_3$ includes the transistor $T_6$, whose base electrode is connected to the interconnected collectors of the transistors $T_1$ and $T_3$ in the current branch $P_1$. The excess feed current $I_S-(I_1+I_2)$ flows out through this third current branch $P_3$. The load resistor R is connected into the emitter supply line of the transistor $T_7$, the collector of which is at the supply voltage $U_S$.

The base electrode of the transistor $T_7$ is connected to the emitters of the transistors $T_6$, $T_3$ and $T_4$ in the three current branches. The stabilized reference voltage $U_{REF}$ is across the load resistor R. The following is true for $U_{REF}$:

$$U_{REF} = U_{BE1} + 2 \cdot \frac{R_1}{R_2} \cdot U_T \ln Fa$$

Where Fa is the area ratio between the emitter areas of the transistor $T_2$ and transistor $T_1$. Since the transistors $T_3$ and $T_4$ have the same area, $I_1=I_2$.

The voltage $U_{REF}$ in the circuit shown in FIG. 3 is completely temperature stabilized if the following condition is fulfilled:

$$v\,U + 2\,\frac{R_1}{R_2} \cdot \frac{K}{e_0} \cdot U_T \cdot \ln Fa = 0$$

Figure 5:
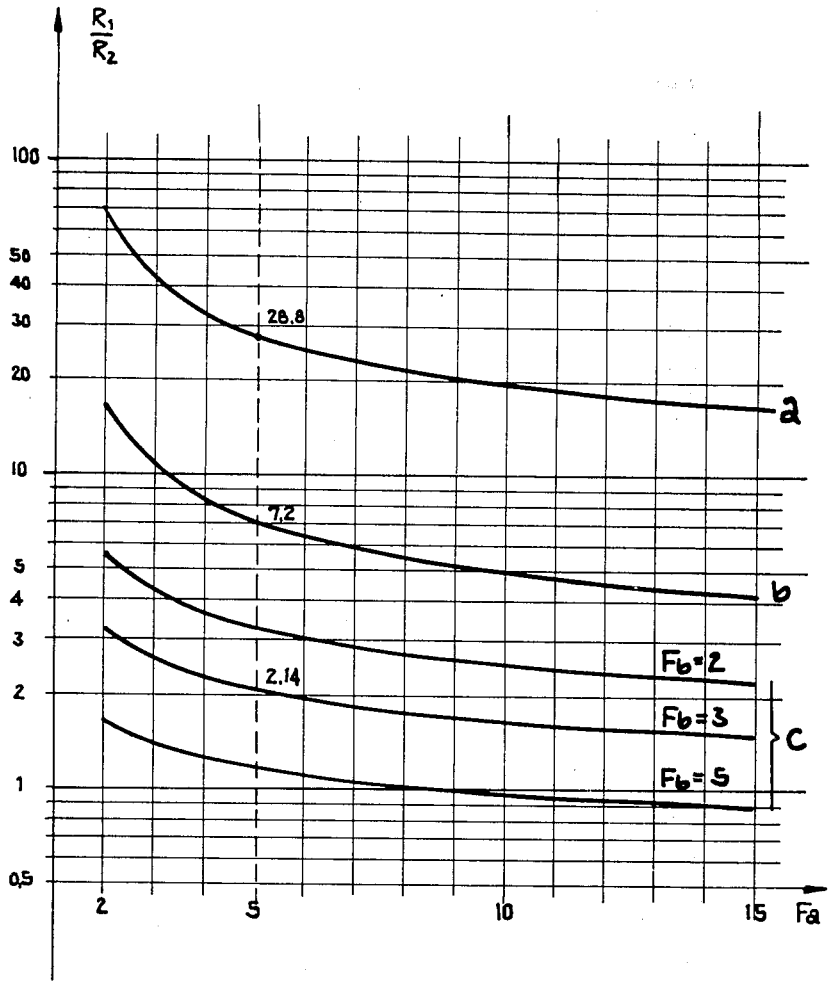
FIG. 5 shows several curves which relate to known circuits and to circuits according to the present invention.

Curve b shown in FIG. 5 applies to this condition. It can be seen that for example with a ratio of Fa=5 the value of the ratio $R_1/R_2$ is 7.2.

Figure 4:
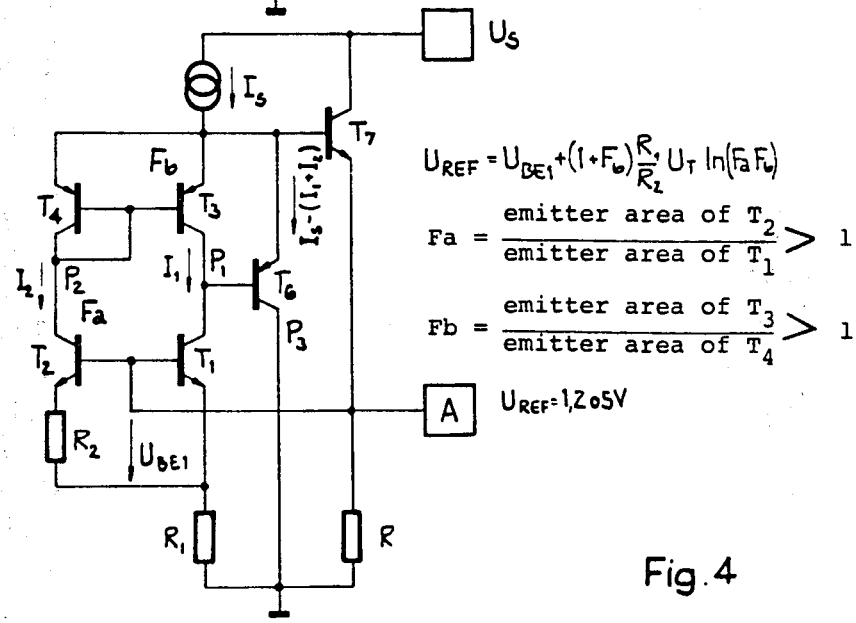
FIG. 4 shows a circuit in accordance with a first embodiment of the present invention.

The present invention seeks to improve the circuit shown in FIG. 3 still further and in particular to reduce the resistor ratio $R_1/R_2$ to a much greater extent. This object is achieved in a circuit of the type described above by providing as the transistors of the first pair and those of the second pair transistors with different active areas, as indicated in FIG. 4. The transistor provided with the emitter resistance in the second current branch having the larger active transistor area within the first transistor pair and that provided in the first current branch having the larger active transistor area within the second transistor pair.

The transistor pairs are formed by the transistors $T_1$ and $T_2$ and by the transistors $T_3$ and $T_4$ respectively, the transistor $T_4$ being operated in the current branch $P_2$ as a diode.

The transistor $T_2$ in the current branch $P_2$ has an emitter resistor $R_2$ whereas the resistor $R_1$ is connected in series with the two parallel connected current branches $P_1$ and $P_2$. The circuit is esentially identical in construction to the circuit according to FIG. 3. However it is important that the transistors $T_3$ and $T_4$ of the current image amplifier have different areas, the area of the transistor $T_3$ being greater than that of the transistor $T_4$. The ratio between the emitter area of the transistor $T_3$ and the emitter area of the transistor $T_4$ is designated Fb and the following applies to the stabilized voltage at the output A of the circuit:

$$U_{REF} = U_{BE1} + (1 + Fb) \cdot \frac{R_1}{R_2} U_T \ln (Fa \cdot Fb).$$

The reference voltage is then stabilized in temperature if:

$$v\, U + \frac{R_1}{R_2} (1 + Fb) \cdot \frac{K}{e_0} \ln (Fa \cdot Fb) = 0.$$

This condition is then fulfilled for the group of curves c shown in FIG. 5 at the values which are apparent from the curves. The upper curve applies to the ratio Fb=2 which means that the emitter area of the transistor $T_3$ is twice as large as that of the transistor $T_4$. If the ratio Fa=5 occurs at the same time then there is a value of approximately 3.3 for the resistor ratio $R_1/R_2$. The ratios are better when Fb=3. This is apparent from the centre curve of the group of curves marked c. Then with a ratio of Fa=5 the resistor ratio $R_1/R_2$ takes on the value 2.14. If Fb=5 is selected in accordance with the lowest selected curve in the group marked c then resistor ratios $R_1/R_2$ are provided which are only slightly above the value 1. These small and easily reproduced resistor ratios can be implemented easily in integrated circuit technology. Relatively small geometric dimensions are required for this.

The different emitter areas of the transistors $T_3$ and $T_4$ can be produced very simply too, since in a practical example they are lateral pnp transistors.

Figure 6:
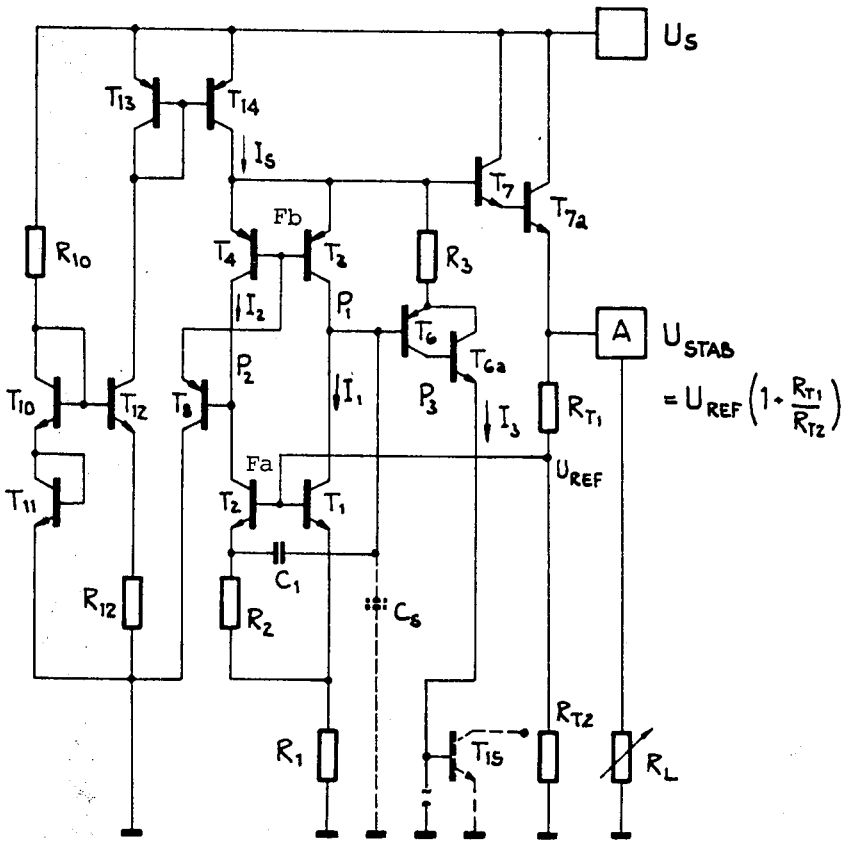
FIG. 6 shows a circuit in accordance with a second embodiment of the present invention.

A workable circuit having further improvements is shown in FIG. 6. The values of Fa, FB, $R_1$ and $R_2$ for this circuit are like those of the circuit of FIG. 4. The current source indicated in the preceding figures for the current $I_S$ is formed by the circuit portion having the transistors $T_{10}$ to $T_{14}$ and the resistors $R_{10}$ and $R_{12}$. The transistors $T_{13}$ and $T_{14}$ form a conventional current image amplifier, in which the transistor $T_{13}$ is operated as a diode and the output current $I_S$ flows through the transistor $T_{14}$. The transistors $T_{13}$ and $T_{14}$ are coupled together at their bases. The transistor $T_{12}$ with the emitter resistor $R_{12}$ lies in the current branch of the transistor $T_{13}$. The base potential of the transistor $T_{12}$ is set with the aid of the transistors $T_{10}$ and $T_{11}$ which are operated as diodes and connected in series. The collector resistor $R_{10}$ of the transistor $T_{10}$ is connected to the voltage source $U_S$. A current $I_S$ which is largely independent of fluctuations in the supply voltage $U_S$ is obtained with the aid of this input current circuit.

The transistor $T_8$ has been inserted into the actual voltage source comprising the current branches $P_1$, $P_2$ and $P_3$, the said voltage source being stable in temperature and the said transistor $T_8$ serves in a manner known per se as an amplifier of the base current of the transistors $T_3$ and $T_4$ of the current image amplifier. It is known for example from U.S. Pat. No. 3,813,607 to insert a base current amplifier into a current image amplifier. The emitter base path of the pnp transistor $T_8$ is parallel to the base collector path of the transistor $T_4$. The collector of the transistor $T_8$ is connected to reference potential. By inserting the base current amplifier $T_8$, a current flows in the collector of $T_4$ which effectively no longer differs from the current flowing through $T_3$.

In the circuit shown in FIG. 6 the transistor $T_6$ has been replaced by the complementary Darlington transistor $T_6$ and $T_{6a}$. This complementary Darlington transistor increases the current amplification factor so that among other things changes in the load can be compensated at the output within broad limits. This positive effect is assisted by the Darlington output transistor $T_7$ and $T_{7a}$.

In order to suppress parasitic oscillations in the MHz range which occur in the feed back amplifier due to the phase shift of the transistor mutual conductance, neutralisation of balancing is necessary. In order to achieve this the capacitor $C_1$ between the emitter of the transistor $T_2$ and the collector electrode of the transistor $T_1$ is provided. This capacitor may be relatively small so that it can be easily integrated into an integrated semiconductor circuit as a MOS circuit. A capacitance $C_1 \approx 30$ pF has proved suitable. The parasitic substrate capacitor at the collector of the transistor $T_1$ is designated $C_S$. The additional resistor $R_3$ which is connected between the emitter electrode of transistor $T_6$ and the emitter electrodes of transistors $T_3$ and $T_4$ serves to make the phase shift of the mutual conductance of the transistors $T_6$ and $T_{6a}$ linear. The size of this resistance is limited however since otherwise the resultant voltage imbalance at the collector electrodes of the transistors $T_3$ and $T_4$ would call into question the stability of the output voltage. The resistor $R_3$ is therefore preferably so dimensioned that the collector voltages at the transistors $T_1$ and $T_2$ or $T_3$ and $T_4$ are approximately equal. In one exemplary embodiment a resistance of $R_3 = 2$ kΩ has proved suitable.

The base emitter path of a transistor $T_{15}$ may also be inserted into the emitter line of the transistor $T_{6a}$ and this additional transistor can be used to produce a pulse which occurs at the collector of the transistor $T_{15}$ since this said transistor is conductive, if current is able to flow though the transistors $T_6$ and $T_{6a}$. A fixed pulse can be produced with the transistor $T_{15}$ exactly at that moment when the desired stabilized voltage is present at the circuit output.

As already mentioned, in the circuit shown in FIG. 6 the load transistor comprises the Darlington transistor $T_7$ and $T_{7a}$, the base electrode of the transistor $T_7$ being coupled to the common connection point of the current branches $P_1$ to $P_2$. The voltage divider comprising the resistors $R_{T1}$ and $R_{T2}$ lies in the emitter supply line of transistor $T_{7a}$. The tapping of this voltage divider is at the reference potential $U_{REF}$ which is temperature stabilized and has the value 1.025 V. A stabilized voltage drops across the load resistor $R_L$, which is in parallel with the voltage divider comprising the resistors $R_{T1}$ and $R_{T2}$ and the following applies:

$$U_{STAB} = U_{REF}\left(1 + \frac{R_{T1}}{R_{T2}}\right).$$

In one example, which has been implemented for a voltage range of the voltage $U_S$ between 3 and 20 volts and with an area ratio of Fb=3 and Fa=5, the resistors had the following values:

$R_{10}$=50 kΩ
$R_{12}$=1 kΩ
$R_2$=1.4 kΩ
$R_1$=3.0 kΩ

It will be understood that the above description of the present invention is susciptible to various modification changes and adaptations.

What is claimed is:

1. A temperature-stabilized voltage supply circuit comprising first and second parallel-connected circuit branches, first and second pairs of interconnected transistors, one transistor from each pair lying in each circuit branch, electrical supply means connected to said current branches, a third circuit branch connected in parallel to said first and second circuit branches, and circuit output means for the temperature-stabilized voltage wherein the active transistor areas of the transistors within each of said pairs are different.

2. A temperature-stabilized voltage source comprising first and second parallel-connected current branches, a first pair of transistors with their base electrodes interconnected, a current image amplifier comprising a second pair of transistors with their base electrodes interconnected, said second pair of transistors being complementary to said first pair, one transistor of each of said pairs lying in each said current branch, a first resistor connected to the emitter of the transistor of said first pair which lies in said second current branch, a second resistor connected in series with said parallel-connected current branches, a third current branch comprising a fifth transistor, the base electrode of said fifth transistor being connected to said first current branch, an activating current branch, said base electrode of said fifth transistor being further connected to said activating current branch, said activating current branch comprising a current source and a sixth transistor, the emitter of said sixth transistor being connected to said base electrodes of said first pair of transistors, and a circuit output for the temperature-stabilised voltage, said emitter of said sixth transistor being further connected to said circuit output, wherein said transistor of said first pair which lies in said second current branch has an active transistor area greater than the active transistor area of the other transistor of said first pair, and the transistor of said second pair which lies in said first current branch has an active transistor area greater than the active transistor area of the other transistor of said second pair.

3. A voltage source as defined in claim 2, the ratio of the active transistor areas of the transistors of said first pair being substantially equal to 5.

4. A voltage source as defined in claim 2, the ratio of the active transistor areas of the transistors of said second pair being substantially equal to 3 or 5.

5. A voltage source as defined in claim 2, said first, second and third current branches meeting at a common point, wherein said fifth transistor in said third current branch is connected to said common point by a third resistor.

6. A voltage source as defined in claim 2 wherein the value of said third resistor is dimensioned to maintain approximately equal collector potentials in each of said transistor pairs.

7. A voltage source as defined in claim 2, said fifth transistor being constituted by a Darlington transistor.

8. A voltage source as defined in claim 2, and further comprising a switching transistor connected to said third current path, said switching transistor producing a switching pulse when a temperature-stabilized voltage appears at said circuit output.

9. A voltage source as defined in claim 2 and further comprising a capacitor connecting said emitter of said transistor of said first pair which lies in said second current branch to the collectors of the transistors which lie in said first current branch.

10. A voltage source as defined in claim 2, said current image amplifier further comprising a seventh transistor, said seventh transistor providing base current, the base-emitter path of said seventh transistor being connected in parallel with the collector-base path of the transistor of said second pair which lies in said second current branch, and the collector of said seventh transistor being connected to earth potential.

* * * * *